US005479665A

United States Patent [19]

Cassidy et al.

[11] Patent Number: 5,479,665

[45] Date of Patent: Jan. 2, 1996

[54] AUTOMATED TRI-FOLD BED

[76] Inventors: Joseph P. Cassidy, 612 Central Ave., Lafayette, Ind. 47905-1864; James L. Meyer; David J. Meyer, both of 1889 180th Ave., Lost Nation, Iowa 52254

[21] Appl. No.: 118,883

[22] Filed: Sep. 9, 1983

[51] Int. Cl.[6] ..... A61G 7/05

[52] U.S. Cl. ..... 5/613; 5/609; 5/618

[58] Field of Search ..... 5/607, 609, 613, 5/616–618, 144

[56] References Cited

U.S. PATENT DOCUMENTS 1,021,335 3/1912 Robinson ..... 5/607
4,375,706 3/1983 Finnhult .
4,527,298 7/1985 Moulton .
4,658,450 4/1987 Thompson .
5,101,519 4/1992 Yamamoto .
5,125,122 6/1992 Chen ..... 5/613
5,303,437 4/1944 Hung ..... 5/613

*Primary Examiner*—Flemming Saether
*Attorney, Agent, or Firm*—Barnes & Thornburg

[57] ABSTRACT

An automated tri-fold bed includes a bed frame, a mattress support that is pivotable between a horizontal configuration and a mattress folding configuration, and a mechanism for pivoting the mattress support about a transversely centered longitudinal pivot axis. The pivoting mechanism includes an actuating arm attached to the mattress support and an actuator for moving the actuating arm to pivot the mattress support. A mechanism is also provided for folding at least one end of the mattress support about a transverse axis to permit raising of one end of a mattress on the mattress support.

21 Claims, 6 Drawing Sheets

AUTOMATED TRI-FOLD BED

BACKGROUND AND SUMMARY OF THE INVENTION

The present invention relates to patient-handling devices and particularly to folding beds. More particularly, the invention relates to automated tri-folding beds having multiple longitudinal support plates for supporting a mattress,-the support plates being tiltable and selectively rotatable about longitudinal axes to provide a V-shaped trough for holding a patient in a transversely tilted position on the bed.

Many disabled people, given the opportunity, would prefer to live at home with a spouse or other caregiver. Oftentimes this is not practical because of the inability of people with certain disabilities to move around, and in particular, to move back and forth while they are lying in a supine position on a bed. An aged spouse or caregiver is often frail and unable to give adequate or sustained assistance of the type needed to help the disabled person turn over on a bed. In some cases, the problems faced by sedentary people cannot be overcome and it becomes necessary to relocate such people to nursing homes or medical care facilities where nurses are present around the clock to help lift, support, transport, and otherwise move debilitated patients.

What is needed is an automated bed that can be used easily in either a home setting or a medical care facility by almost anyone to help move sedentary people from one position to another. Ideally, such an apparatus would be fully automated so that it could be controlled and operated by the person seeking increased mobility. In any case, the apparatus should be motorized and designed so that it can be operated by an aged or frail spouse or caregiver to turn the patient over while that patient remains lying down. Ideally, such an automated bed would be integrated into a comprehensive patient transport system for helping non-ambulatory patients move between beds, chairs, and bathroom facilities at home or in a medical care facility.

It is desirable to be able to move bedridden patients onto their sides from time to time for various reasons. For example, bedridden patients are subject to getting bed sores and can develop muscular discomfort if they are not moved regularly. In addition, moving the patient facilitates changing the bed linens and ministering to the needs of the patient.

Multi-position beds and adjustable sectional beds are known. For example, see U.S. Pat. Nos. 156,318 to Supplee; 1,740,906 to Rothauszky et al.; 2,284,470 to Comper et al.; 2,522,018 to Blackman; 3,013,281 to Steiner; 3,300,793 to Thompson; 3,875,598 to Foster et al.; 4,287,620 to Zur; 4,375,706 to Finnhult; 4,225,988 to Cary et al.; 4,658,450 to Thompson; 4,084,274 to Willis et al.; and 5,101,519 to Yamamoto.

According to the present invention, a tri-fold bed comprises a bed frame, means for supporting a mattress, the supporting means being pivotable between a horizontal planar configuration and a mattress folding configuration, and means for pivoting the supporting means about a transversely centered longitudinal axis. The pivoting means includes an actuating arm rigidly attached to the supporting means and horizontally disposed actuating means.

The actuating means is transversely mounted on the bed frame and has a first end rigidly attached to the bed frame and a second end coupled to a link which is, in turn, coupled to the actuating arm. The second end is movable between a compressed position, a centered position, and an extended position. When the second end is in the centered position, the supporting means is in the horizontal planar configuration. As the second end moves away from the centered position, the actuating arm pivots the supporting means about the central longitudinal axis from the horizontal planar configuration to the mattress folding configuration.

The supporting means includes a pair of outer support plates and a center support plate hingedly coupled to, and positioned between, the outer support plates. As the supporting means pivots toward the mattress folding configuration, one of the outer plates moves to a lowered position, and the other outer plate moves to a raised position, relative to the center plate.

The invention further includes a plurality of rollers coupled to the bed frame. When the supporting means is pivoted to the mattress folding configuration, the rollers interfere with the downward movement of the lower outer plate, causing the lower outer plate to rotate about its hinged connection to the center plate to form a V-shaped trough with the remaining plates for holding the patient in a transversely tilted position.

A transverse brace is attached to the center plate and extends transversely beyond the center plate to underlie and support the outer support plates. When the supporting means is in the horizontal planar configuration, the transverse brace supports the center plate and at least a portion of both outer plates. In the mattress folding configuration, the transverse brace supports the center plate and at least a portion of the raised outer support plate.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAINED DESCRIPTION OF THE DRAWINGS

Figure 1:
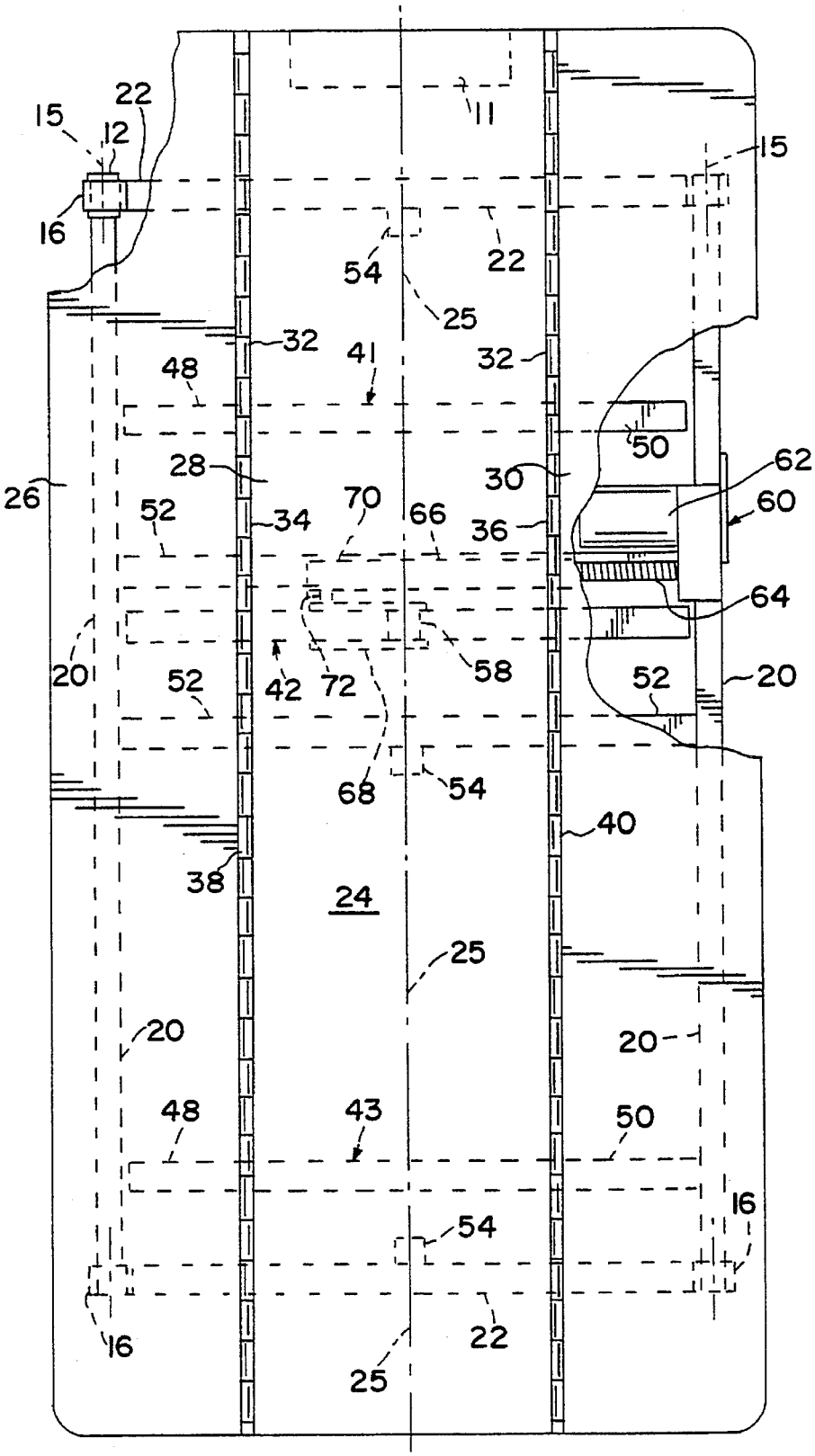
FIG. 1 is a plan view of an automated tri-fold bed (without a mattress) according to the present invention, with portions broken away, showing a bed frame, three longitudinally extending mattress support plates hinged for pivotable movement relative to the bed frame, and an actuating linkage for pivoting two of the mattress support plates in unison relative to a third of the mattress support plates to assist in turning over a patient lying on a mattress carried on the three mattress support plates.

A tri-fold bed 10 constructed according to a first embodiment of the present invention is shown in FIGS. 1–4. The bed 10 includes a plurality of legs 12 supporting a bed frame 14. Each leg 12 includes a roller 16 rotatably coupled to the top portion 18 (FIGS. 2–4) of each leg 12 for rotation about an axis that lies parallel to the longitudinal axis 15 of the bed 10. The rollers 16 are positioned so that the arc of the rollers 16 extend vertically beyond the top portion 18 of the legs 12.

The bed frame 14 includes a plurality of horizontal, longitudinally extending side members 20 and a plurality of horizontal, transversely extending end members 22. The side members 20 and the end members 22 extend between, and are attached to, the legs 12 in a conventional fashion. The bed frame 14 also includes supplemental horizontal transverse support members 52 extending between, and attached to, the side members 20. A plurality of supplemental vertical support members 54 are centered on the transverse members 52 and are orthogonally attached thereto.

The tri-fold bed 10 also includes a surface 24 pivotable about a central longitudinal pivot axis 25 for supporting a mattress (not shown). The surface 24 is divided into three longitudinally extending plates 26, 28, 30. The three plates 26, 28, 30 include a center plate 28 hingedly coupled to right and left outer plates 26, 30 by longitudinally extending hinges 32 attached to the inside lateral edges 34, 36 of the outer plates 26, 30, respectively, and the adjacent lateral edges 38, 40 of the center plate 28. The outer plates 26, 30 are positioned to rest on the rollers 16 when the surface 24 is in the horizontal position. The center plate 28 is mounted to the upper end 56 for rotation about the pivot axis 25.

A plurality of transverse braces 41, 42, 43 are attached to the center plate 28 and extend beyond the lateral edges 38, 40 of center plate 28. The extending portions 48, 50 of the transverse braces 41, 42, 43 underlie and support at least a portion of each outer plate 26, 30, but are not attached to the outer plates 26, 30. Thus, the outer plates 26, 30 are free to rotate upwardly about the hinges 32, but are limited in their downward rotation by the transverse braces 41, 42, 43.

A downwardly extending actuator arm 58 is orthogonally attached to transverse brace 42. To minimize torsional effects along the length of the bed 10, the actuator arm 58 is preferably attached to a transverse brace 42 that is approximately centered along the longitudinally axis of the bed 10, but it could be attached to any transverse brace 41, 42, 43 without exceeding the scope of the invention.

An actuator 60 is transversely mounted on the bed frame 14 for horizontal movement. A preferred actuator 60 is an electrically-driven threaded screw, but any suitable driving mechanism can be used. The actuator 60 includes a motor 62 for rotating a threaded screw 64. A driven member 66 is internally threaded to engage the threaded screw 64 for movement therealong in response to rotation of the threaded screw 64 by the motor 62. A yoke 68 is pivotally coupled to the distal end 70 of the driven member 66 by a pin 72 and to the downward end 74 of the actuator arm 58 by pin 76, thereby coupling the threaded screw 64 to the actuator arm 59.

Figure 2:
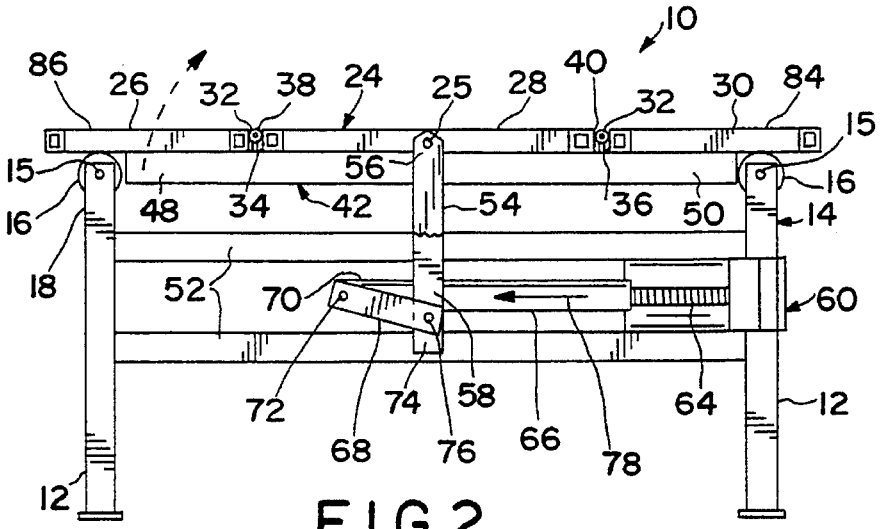
FIG. 2 is a dead section view of the tri-fold bed of FIG. 1 showing the actuating linkage mounted to the bed frame and moved to a centered position to arrange the three mattress support plates so that they lie side-by-side in a horizontal planar configuration.
Figure 3:
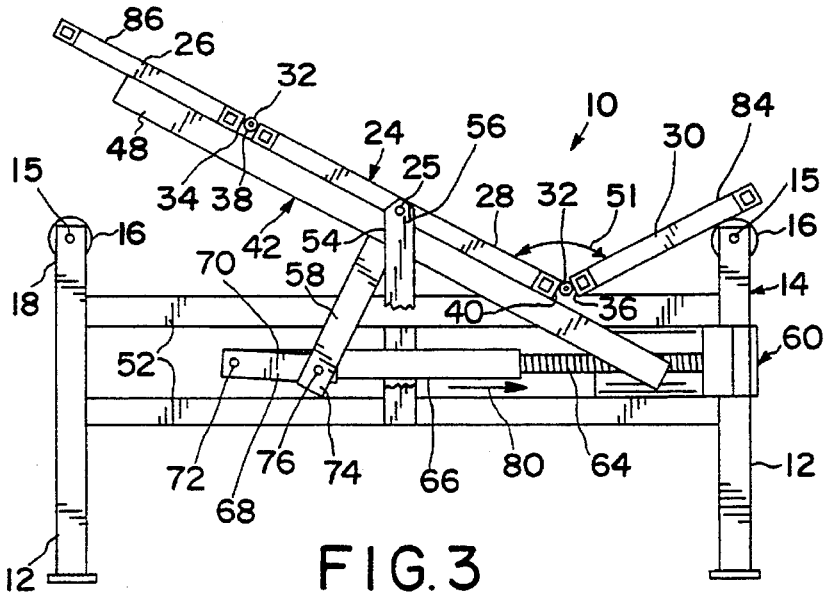
FIG. 3 is a dead section view similar to FIG. 2 showing the actuating linkage in an extended position causing the mattress support plates to pivot relative to the bed frame and form a V-shaped trough for holding a patient lying in the bed in a transversely tilted position facing forward one side of the bed.
Figure 4:
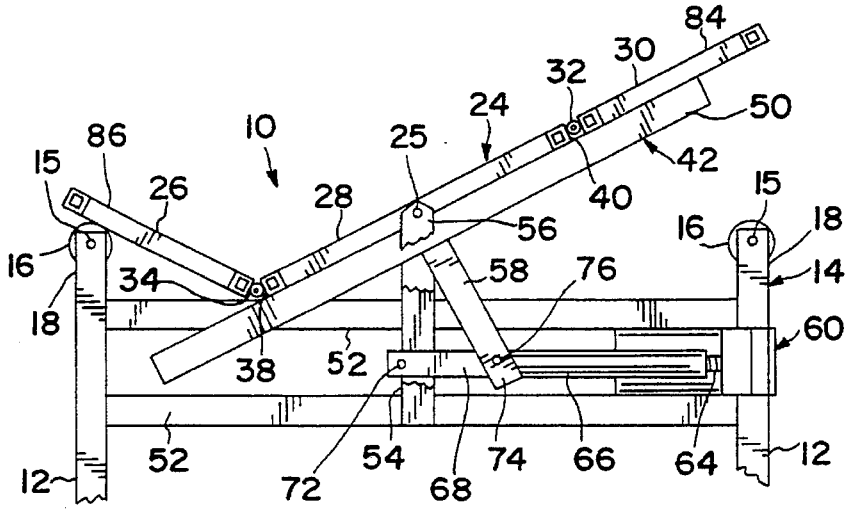
FIG. 4 is a dead section view similar to FIG. 2 showing the actuating linkage in a retracted position causing the mattress support plates to pivot relative to the bed frame in the opposite direction forming a different V-shaped trough for holding the patient in a different transversely tilted position facing toward the other side of the bed.

Referring to FIGS. 2–4, as the motor 62 rotates the threaded screw 64, the driven member 66 moves between an extended position (FIG. 3) and a retracted position (FIG. 4) and can be stopped at a centered position (FIG. 2) intermediate the extended and retracted positions or at any selected point between the extended and retracted positions. When the driven member 66 is in the centered position (FIG. 2), the mattress support plates 26, 28, 30 are positioned so that they lie side-by-side in a horizontal configuration, with the support plates 26, 28, 30 supported by the transverse braces 41, 42, 43 and the outer support plates 26, 30 additionally supported by the rollers 16.

As the motor 62 is actuated to rotate the threaded screw 64 in a first direction, the driven member 66 moves in direction 78 (FIG. 2). The actuator arm 58, coupled to the driven member 66 by the yoke 68, is rotated in a clockwise direction (as viewed in FIGS. 2–4) about the pivot axis 25. The transverse braces 41, 42, 43 and center plate 28 rotate with the actuator arm 58 and tilt the mattress support surface 24 towards the right (FIG. 3).

As the support surface 24 tilts, the laterally extending portions 48 of the transverse braces 41, 42, 43 lift the left outer plate 26 away from the rollers 16. At the same time, the laterally extending portions 50 of the braces 41, 42, 43 drop away from the right outer plate 30. However, the laterally outward portion 84 of the right outer support plate 30 remains supported by the rollers 16 and does not drop with the laterally extending portions 50 of the braces 41, 42, 43. Since the inside lateral edge 36 is coupled to the center plate 28 by the hinge 32, the right support plate 30 is supported at an obtuse angle 51 to the center plate 28, forming a V-shaped trough for holding a patient on his side facing the right side of the bed.

The support surface 24 can also be tilted in the opposite direction as shown in FIG. 4. As the motor 62 is actuated to rotate the threaded screw 64 in a second direction opposite to the first direction, the driven member 66 moves in direction 80 (FIG. 3). The actuator arm 58, coupled to the driven member 66 by the yoke 68, is rotated in a counter-clockwise direction (as viewed in FIGS. 2–4) about the pivot axis 25. The transverse braces 41, 42, 43 and center plate 28 rotate with the actuator arm 58 and tilt the mattress support surface 24 to the left (FIG. 4).

As the support surface 24 tilts, the laterally extending portions 50 of the transverse braces 41, 42, 43 lift the right outer plate 30 away from the rollers 16. At the same time, the laterally extending portions 48 of the braces 41, 42, 43 drop away from the left outer plate 26. However, the laterally outward portion 86 of the left outer plate 30 remains supported by the rollers 16 and does not drop with the laterally extending portions of the braces 41, 42, 43. Since the inside lateral edge 34 is coupled to the center plate 28 by the hinge 32, the left support plate 26 is supported at an acute angle to the center plate 28, forming a V-shaped trough for holding a patient on his side facing the left side of the bed.

Advantageously, the tri-fold mechanism of the present invention tilts the mattress support surface about a central axis that lies substantially along the patient's back. Thus, by tilting the support surface (and patient), the present invention avoids the need for heavy equipment necessary to lift the supporting surface (and patient) about an axis that is offset from the center of the bed.

Preferably, the bed 10 is automated to make it easy for people to control the position of the mattress-supporting surfaces while a patient is lying on the bed 10. The bed 10 is provided with a fully sequential, solid state, multi-control master control system 11 (see FIGS. 1 and 7) that, for example, is configured to move the bed through a cycle of operation as shown in FIGS. 2–4 to cause the patient to be turned over between left and right sides. The bed turner control can be operated during each cycle to raise one side of bed 10 to a preset angle, hold the bed in such angled position for a set period of time, lower the angled side to a flat position for a set period of time, raise the other side of the bed a preset angle for a set period of time, and lower the bed to a flat position. The cycle time is adjustable so that one cycle can be completed between, for example, five minutes and one hour.

A pendant switch (not shown) is provided to start and stop the apparatus. Limit switches (not shown) can be used to trigger actuation of the actuating linkage and a toggle switch (not shown) can be provided to skip any wait or delay at the flat center position of the bed. Various relay circuits and timers (not shown) can be used to control cycling and timing of bed operation. For example, such circuits and timers could be programmed to move the bed to the position shown in FIG. 3 and hold it there for a period of time and, if desired, then move the bed to the position shown in FIG. 4 and hold it there for a period of time during each cycle. In addition, the whole bed can be raised or lowered as a unit (not shown) and the head and foot can be raised together or individually to suit the needs of a patient in the bed. Adjustable brackets (not shown) can be mounted on the bed frame to adjust and fix the maximum angle of the pivotable mattress support panels.

As shown in FIGS. 5–10, a hospital bed 100 includes a longitudinal tri-folding mechanism and independent head and foot elevating mechanisms. The hospital bed 100 can be operated to fold about transverse axes 102, 104, 106 to elevate a head portion 108 and/or a foot portion 110 of the bed 100 relative to a center portion 109.

Figure 5:
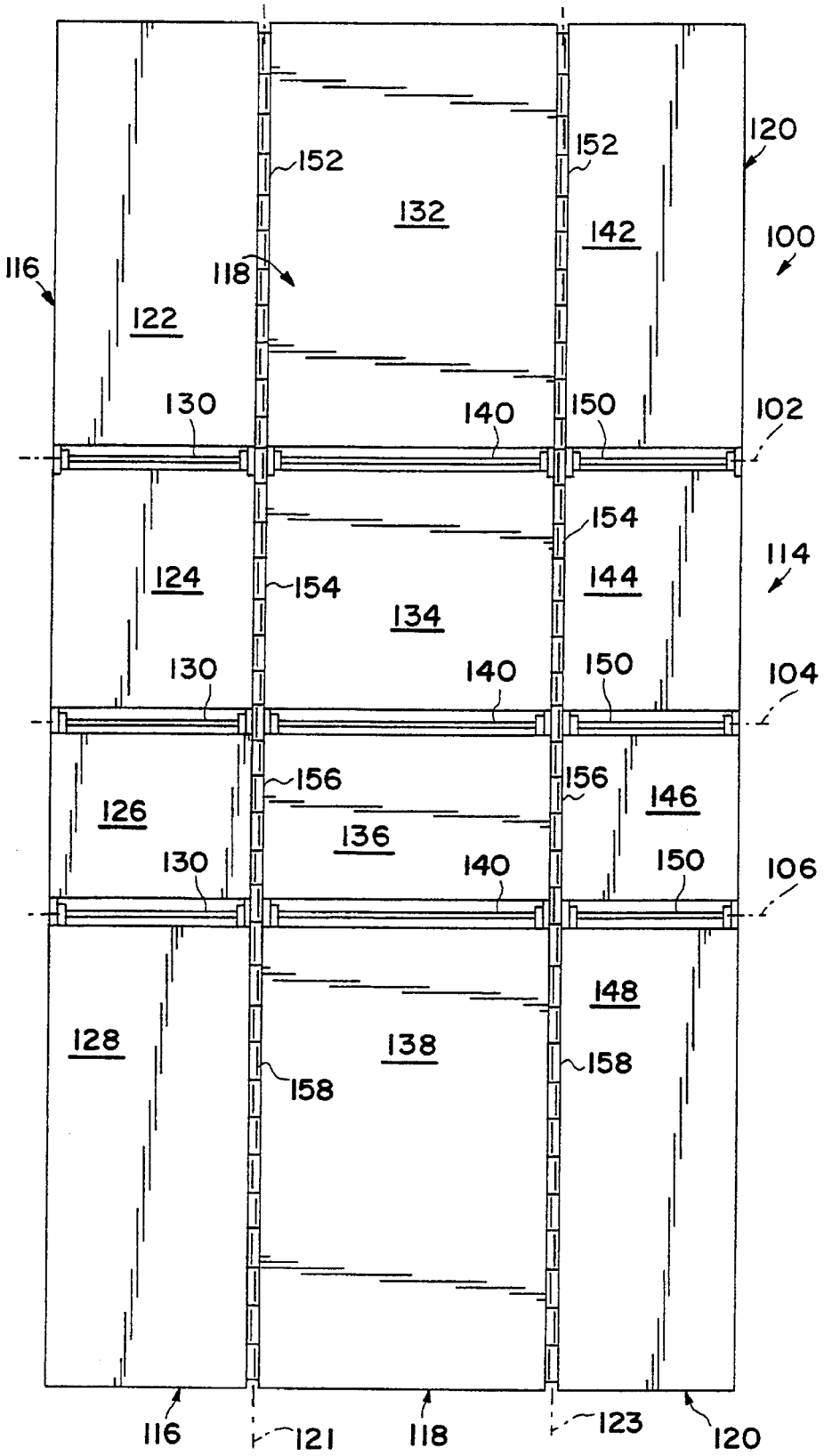
FIG. 5 is a plan view of the mattress support plates in accordance with another embodiment of the invention showing a tri-fold hospital bed which is capable of elevating separate head and foot portions of the three pivotable, longitudinally extending mattress support plates.

In the tri-folding hospital bed 100, a plurality of panels cooperate to form a mattress-supporting surface 114 having left and right outer plates 116, 120 hingedly connected to a center plate 118 for rotation about longitudinal axes 121 and 123. As shown in FIG. 5, panels 122, 124, 126, and 128 are coupled to each other by hinges 130 to form left outer plate 116. Panels 132, 134, 136, and 138 are coupled to each other by hinges 140 to form center plate 118, and panels 142, 144, 146, and 148 are coupled to each other by hinges 150 to form right outer plate 120. The outer plates 116, 120 are coupled to the center plate 118 by hinges 152, 154, 156, and 158 positioned sequentially along the adjacent lateral edges of the plates 116, 118 and 120. Hinges 130, 140, and 150 cooperate to form transverse axes 102, 104, 106, and hinges 152, 154, 156, and 158 cooperate to form longitudinal axes 121, and 123.

Figure 6:
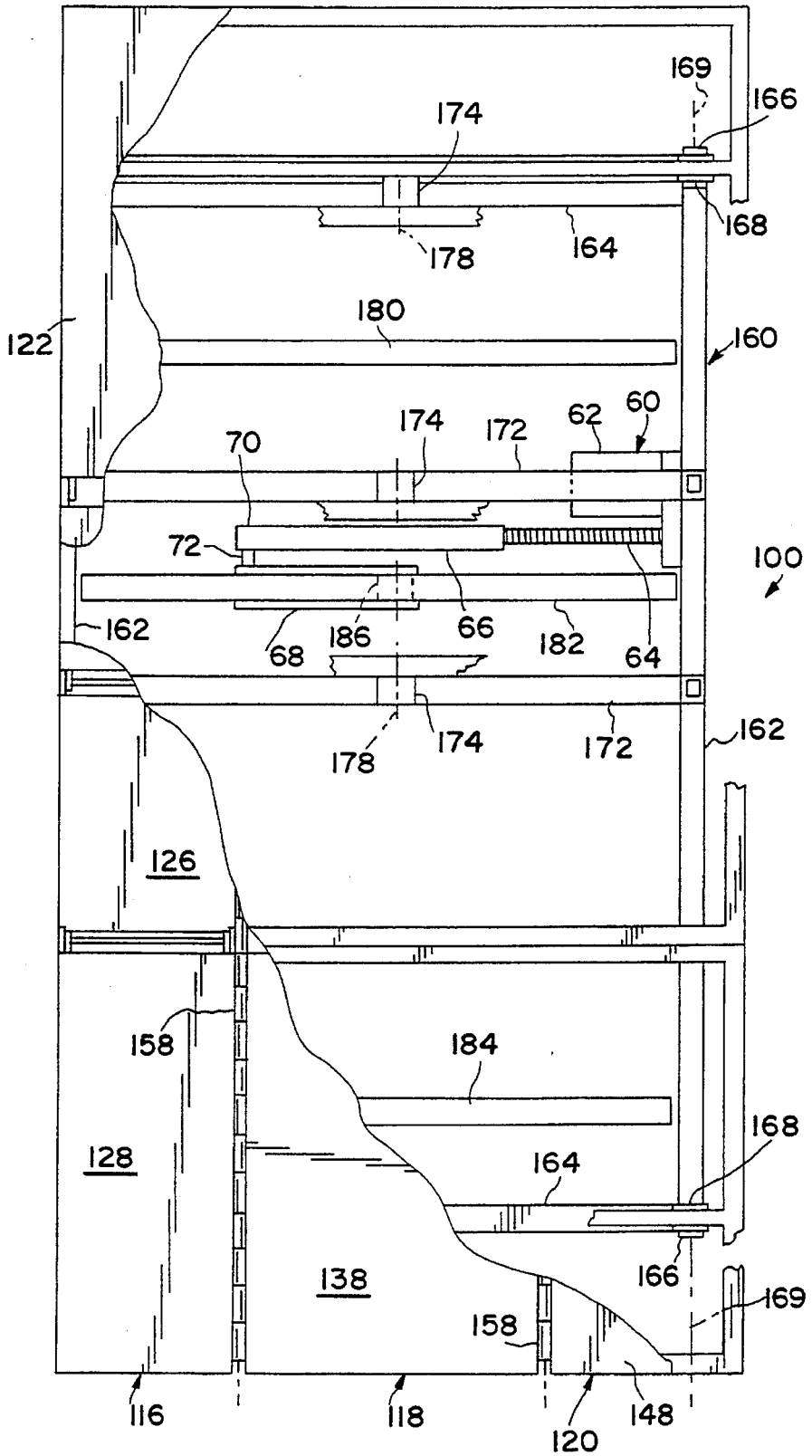
FIG. 6 is a plan view of the tri-fold hospital bed of FIG. 5 partly broken away to expose an underlying bed frame and an actuating linkage for pivoting the mattress support panels relative to the bed frame and to one another.

The mattress-supporting surface 114 rests upon a bed frame 160, as shown in FIG. 6. The bed frame 160 includes a plurality of horizontal, longitudinally extending side members 162 and a plurality of horizontal, transversely extending end members 164. The frame 160 is supported by a plurality of legs 166, wherein each leg 166 includes a roller 168 rotatably coupled to the top portion 170 (FIGS. 7–10) of each leg 166 for rotation about axis 169 that lies parallel to the longitudinal axes 121, 123. The rollers 168 are positioned so that the arc of the rollers 168 extends vertically beyond the top portion 170 of the legs 166 as best seen in FIGS. 7–10. The side members 162 and the end members 164 extend between, and are attached to, the legs 166 in a conventional fashion.

The bed frame 160 also includes supplemental horizontal transverse support members 172 extending between, and attached to, the side members 162. A plurality of supplemental vertical support members 174 are centered on the transverse members 172 and are orthogonally attached thereto and extend upwardly therefrom. The center plate 118 is mounted to the upper end of the vertical members 174 for rotation about a central pivot axis 178.

A plurality of transverse braces 180, 182, 184 are attached to the center plate 118 and extend beyond the lateral edges of center plate 118 to underlie and support at least a portion of each outer plate 116, 120, but are not attached to the outer plates 116, 120. Thus, the outer plates 116, 120 are free to rotate upwardly about the hinges 152, 154, 156, 158 but are limited in their downward rotation by the transverse braces 180, 182, 184.

A downwardly extending actuator arm 186 is orthogonally attached to transverse brace 182. To minimize torsional effects along the length of the hospital bed 100, the actuator arm 186 is preferably attached to a transverse brace 182 that is approximately centered along the longitudinally axis of the bed 100, but it could be attached to any transverse brace 180, 182, 184 without exceeding the scope of the invention.

An actuator 60 is transversely mounted on the bed frame 160 for horizontal movement. A preferred actuator 60 is an electrically driven threaded screw, but any suitable driving mechanism can be used. The actuator 60 includes a motor 62 for rotating a threaded screw 64. A driven member 66 is internally threaded to engage the threaded screw 64 for movement therealong in response to rotation of the threaded screw 64 by the motor 62. A yoke 68 is pivotally coupled to the distal end 70 of the driven member 66 by a pin 72 and to the downward end 74 of the actuator arm 186 by pin 76, thereby coupling the threaded screw 64 to the actuator arm 186.

The above described mechanism folds the tri-folding hospital bed 100 in either direction about the longitudinal axes 121, 123 in the same way as previously described with reference to FIGS. 1–4. Additionally, the bed 100 folds about the transverse axes 102, 104, 106 to elevate the head portion 108 (FIG. 8) and to elevate the foot portion 110 (FIG. 9) of the bed 100 relative to the center portion 109.

Figure 7:
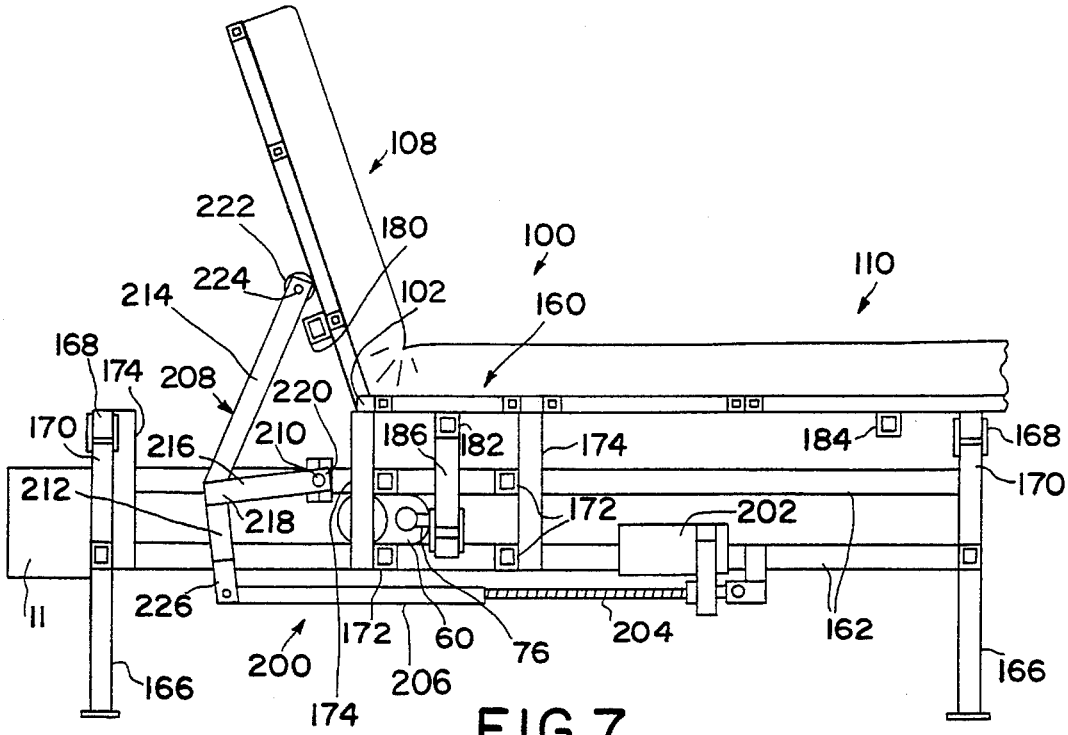
FIG. 7 is a side view of a portion of the tri-fold hospital bed of FIG. 5 showing a head-elevating mechanism in an expanded position supporting the head portion of the bed in an elevated position.
Figure 8:
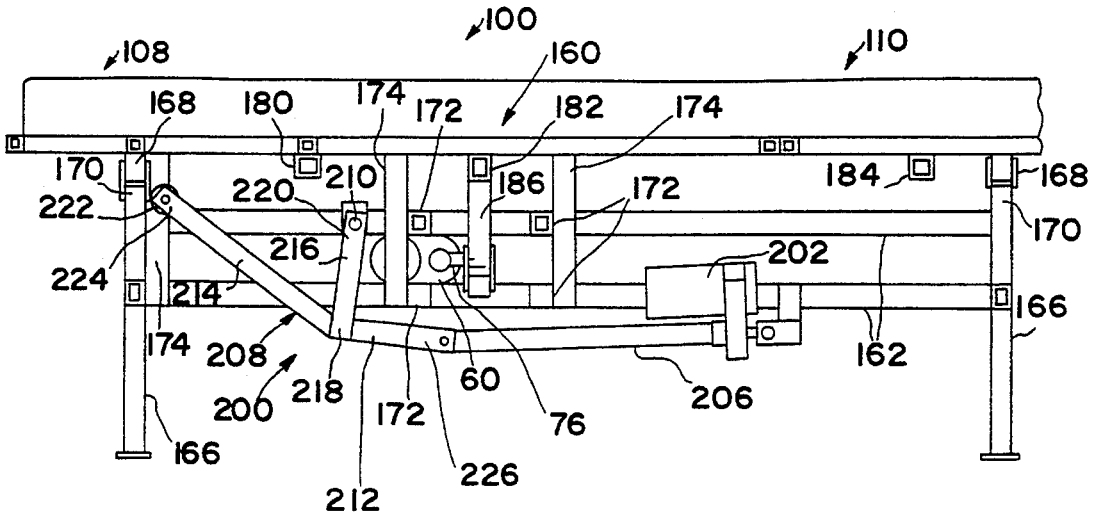
FIG. 8 is a view similar to FIG. 7 showing the head-elevating mechanism after it has been moved to a retracted position allowing the head portion of the bed to rest on the bed frame in a lowered position.

A mechanism 200 for elevating and lowering the head portion 108 of the bed 100 is shown in FIG. 7 with the head portion 108 in the elevated position and in FIG. 8 with the head portion 108 in a lowered position. It should be noted that the mechanism 200 completely disengages from the head portion 108 in the head lowered position (FIG. 8) in order to avoid interference during the longitudinal folding of the bed 100 about axes 121, 123.

The mechanism 200 includes a motor 202, a threaded screw 204 rotated by the motor 202, a driven member 206, and a bellcrank 208. The driven member 206 is internally threaded to engage the threaded screw 204 for axial movement therealong in response to rotation of the threaded screw 204 by the motor 202. The bellcrank 208 is pivoted a pivot axis 210 in response to the axial movement of the driven member 206.

The bellcrank 208 includes first and second action members 212,214 joined together to form an obtuse angle therebetween and a pivot arm 216. The pivot arm 216 includes a proximal end 218 attached to the first action member 212 at a right angle thereto, and a distal end 220 pivotally coupled to the bed frame 160 at the pivot axis 210. The second action member 214 includes a distal end 224 having a roller 222 rotatably coupled thereto.

The first action member 212 includes a proximal end 226 pivotally coupled to the driven member 206. Rotation of the motor 202 in a first direction drives the driven member 206 axially away from the motor 202, which pivots the bellcrank 208 clockwise about the pivot axis 210, moving the roller 222 into contact with the head portion 108 of the bed 100. Continued rotation of the bellcrank 208 causes the roller 222 to roll along the head portion 108 generally toward the foot portion 110, elevating the head portion 108 by pivoting the head portion about transverse axis 102.

From the head elevated position shown in FIG. 7, rotation of the motor 202 in a second direction opposite to the first direction drives the driven member 206 axially toward the motor 202, which rotates the bellcrank 208 counterclockwise. As the bellcrank 208 rotates counterclockwise, the roller 222 rolls along the head portion 108 generally away from the foot portion 110, allowing the head portion 108 to move to the lowered position, as shown in FIG. 8. The placement of the motor 202 on the frame 160 and the length of the threaded screw 204 combine to pull the driven member 206 far enough toward the motor 202 to completely disengage the bellcrank 208 and move it completely away from the mattress support surface 114. Complete disengagement of the bellcrank 208 allows the bed 100 to fold longitudinally about the axes 121, 123 without interference by the bellcrank 208.

Figure 9:
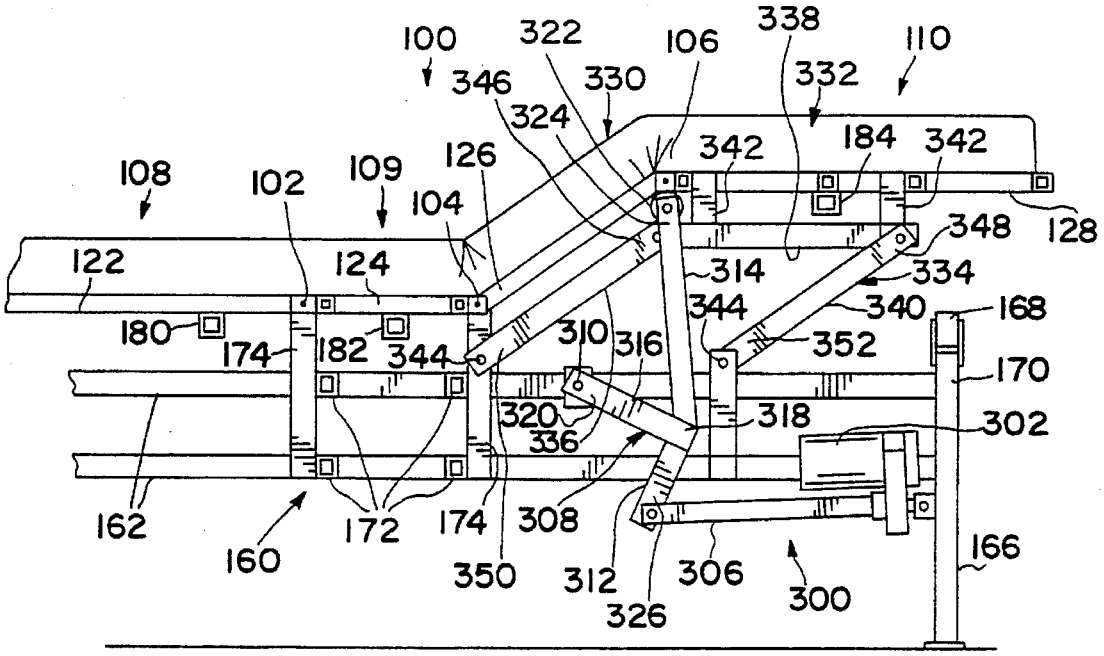
FIG. 9 is a partial side view of a portion of the tri-fold hospital bed of FIG. 5 showing a foot-elevating mechanism in an expanded position supporting the foot portion of the bed in an elevated position.
Figure 10:
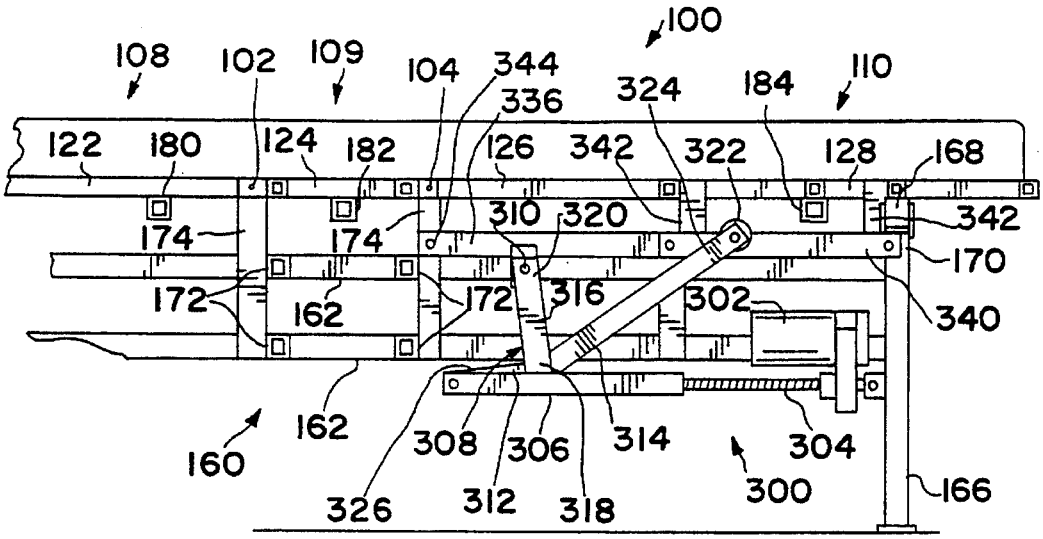
FIG. 10 is a view similar to FIG. 9 showing the foot-elevating mechanism after it has been moved to a retracted position allowing the foot portion to move to its lowered position and a fully disengaged position to avoid interference between the foot-elevating mechanism and the tri-folding action of the bed.

Referring to FIGS. 9–10, a mechanism 300 similar to mechanism 200 is incorporated into the hospital bed 100 to elevate the foot portion 110. The mechanism 300 includes a motor 302, a threaded screw 304 rotated by the motor 302, an driven member 306, and a bellcrank 308. The driven member 306 is internally threaded to engage the threaded screw 304 for axial movement therealong in response to rotation of the motor 302. The bellcrank 308 is positioned to be pivoted about a pivot axis 310 in response to the axial movement of the driven member 306.

The bellcrank 308 includes first and second action members 312, 314 joined together to form an obtuse angle therebetween and a pivot arm 316. The pivot arm 316 includes a proximal end 318 attached to the first action member 312 at a right angle thereto, and a distal end 320 pivotally coupled to the bed frame 160 at the pivot axis 310. The second action member 314 includes the distal end 324 having a roller 322 rotatably coupled thereto.

The first action member 312 includes a distal end 326 pivotally coupled to the driven member 306. Rotation of the motor 302 in a first direction drives the driven member 306 axially toward the motor 302, which pivots the bellcrank 308 counterclockwise about the pivot axis 310, moving the roller 322 into contact with the foot portion 110 of the bed 100. Continued rotation of the bellcrank 308 causes the roller 322 to roll along the foot portion 110 generally toward the head portion 108, elevating the foot portion 110 relative to the center portion 109.

The foot portion 110 further includes a proximal section 330 pivotally coupled to the center portion 109 for movement about transverse axis 104, and a distal section 332 pivotally coupled to the proximal section 330 for movement about transverse axis 106. A parallelogram linkage 334 couples the distal section 332 of the foot portion 110 to the bed frame 160. The linkage 334 includes first, second, and third link members 336, 338, 340. The second link member 338 is pivotally connected to the proximal ends 346, 348 of the first and third link members 336, 340, respectively, and rigidly coupled to panel 128 by straps 342. The distal ends 350, 352 of the first and third link members 336, 340, respectively, are pivotally coupled to the bed frame 160 at pivot axes 344.

As the bellcrank 308 pivots counterclockwise to elevate the foot portion 110, the parallelogram linkage 334 maintains the distal section 332 in a horizontal parallel relationship to the bed frame 160, rotating relative to the proximal section 330 about the pivot axis 106. As the distal section 332 elevates, the proximal section 334 rotates relative to the center portion 109 about the pivot axis 104.

For purposes of clarity, the foot portion elevating mechanism 300 has not been included in FIGS. 7–8. Likewise, the head portion elevating mechanism 200 has not been included in FIGS. 9–10. It will be understood, however, that mechanisms 200 and 300 can be incorporated into the same bed so that both the head portion 108 and the foot portion 110 can be elevated. Moreover, it will be further understood that the foot portion 110 and head portion 108 can be elevated at the same time on the same bed without exceeding the scope of the present invention.

Although the invention has been described in detail with reference to a certain preferred embodiment, variations and modifications exist within the scope and spirit of the invention as described and defined in the following claims.

We claim:

1. an automated tri-fold bed comprising a bed frame;

means for supporting a mattress, the supporting means being pivotable between a horizontal planar configuration and a mattress folding configuration, means for pivoting the supporting means about transversely centered longitudinal pivot axis, the piovoting means including an actuating arm rigidly attached to the supporting means and oriented orthogonally thereto, and actuating means for moving the actuating arm to pivot the supporting means, the actuating means being horizontally disposed and transversely mounted on the bed frame and having a first end rigidly attached to the bed frame and a second end coupled to a link, the link being coupled to the actuating arm, and means for folding at least one end of the supporting means about a transverse axis to permit raising of one end of the mattress, said means to fold being normally detached from the supporting means and movable to abut and rise the supporting means to raise the end of the mattress.

2. The bed of claim 1, wherein the supporting means includes a pair of outer support plates having inner and outer longitudinal edges and a center support plate positioned intermediate the outer support plates and having parallel longitudinal edges, the inner edges of the outer support plates being hingedly coupled to the longitudinal edges of the center support plate.

3. The bed of claim 2, wherein the supporting means further includes a transverse brace coupled to the center support plate and the actuating arm and extending transversely beyond the center support plate to underlie and brace at least a portion of the outer support plates in the horizontal planar configuration.

4. The bed of claim 3, further comprising rollers coupled to the bed frame, the transverse brace cooperating with the rollers to cause a first of the pair of outer support plates to rotate about a longitudinal axis relative to the center support plate and the other of the pair of outer support plates, the transverse brace maintaining the center support plate and the other outer support plate in a non-horizontal planar configuration so that the first of the pair of outer support plates cooperates with the remaining support plates to form a V-shaped trough for holding a patient in a transversely tilted position on the bed.

5. The bed of claim 1, wherein the second end of the actuating means includes a driven member movable between a retracted position, a centered position, and an extended position, the supporting means being in the horizontal planar configuration when the driven member is in the centered position, and movement of the driven member from the centered position pivots the supporting means to a mattress folding configuration.

6. The bed of claim 1, means for folding the supporting means about a first transverse axis elevates a head portion of the bed.

7. The bed of claim 6, further including second means for folding the supporting means about a second transverse axis to elevate a foot portion of the bed.

8. The bed of claim 7, further including third means for folding the supporting means about third axis, wherein the foot portion of the bed includes a proximal section and a distal section and the proximal section rotates relative to the head portion about the second transverse axis and the distal section rotates relative to the proximal section about a third transverse axis to allow the distal section of the foot portion to maintain one of a horizontal and inclined orientation.

9. A automated tri-fold bed comprising:

a bed frame having a longitudinal axis, a plurality of rollers coupled to the bed frame, a plurality of support plates supporting a mattress, the support plates being movable between a horizontal planar configuration and a mattress folding configuration, means for bracing the support plates, mean for pivoting the bracing means transversely about a central longitudinal pivot axis to pivot the support plates from the horizontal planar configuration to the mattress folding configuration, the bracing means cooperating with the rollers to cause a first of the plurality of support plates to rotate about a longitudinal axis relative to the remaining support plates when the bracing means rotates to the mattress folding configuration, the bracing means maintaining the remaining support plates in a non-horizontal planar configuration so that the first of the plurality of support plates cooperates with the remaining support plates to fold the mattress to form V-shaped through for holding a patient in a transversely tilted position on the bed, and means for folding at least one end of the supporting plates about a transverse axis to permit raising of one end of the mattress, said means to fold being normally detached from the supporting means and movable to abut and rise the supporting means to raise the end of the mattress.

10. The bed of claim 9, wherein the pivoting means includes an actuating arm rigidly coupled to the bracing means and means for actuating the pivoting means.

11. The bed of claim 10, wherein the actuating means includes a first end attached to the bed frame and a second end coupled to a link, the link being coupled to the actuating arm.

12. The bed of claim 11, wherein the second end includes a driven member movable between a retracted position, a centered position, and an extended position, the support plates being in the horizontal planar configuration when the actuating means is in the centered position, and movement of the actuating means from the centered position pivots the support plates to the mattress folding configuration.

13. The bed of claim 9, wherein the support plates include a pair of outer plates and an center plate hingedly coupled to the outer plates and positioned therebetween and the bracing means includes a transverse brace attached to the center plate.

14. The bed of claim 13, wherein the transverse brace extends transversely beyond the center plate to underlie at least a portion of the outer plates when the support plates are in the horizontal planar configuration and to underlie at least a portion of at least one of the outer plates when the support plates are in the mattress folding configuration.

15. The bed of claim 9, wherein the means for folding the support plates about a first transverse axis elevates a head portion of the bed and second means for folding the bed about a second transverse axis to elevate a foot portion of the bed.

16. The bed of claim 15, further including third means for folding the support plates about a third transverse axis to allow the foot portion of the support plates bed to be moved to a raised horizontal position.

17. An automated tri-fold bed comprising a bed frame having a longitudinal axis, a plurality of rollers coupled to the bed frame, means for supporting a mattress, the supporting means being coupled to the bed frame and pivotable between a horizontal planar configuration and a mattress folding position, means for pivoting the supporting means about a transversely centered longitudinal pivot axis, the supporting means and the rollers cooperating to fold the mattress parallel to the centered longitudinal axis of the bed frame when the supporting means is pivoted, means for actuating the pivoting means to pivot the supporting means toward one side of the bed to fold the mattress, the actuating means being horizontally disposed and transversely mounted on the bed frame and having a first end rigidly attached to the bed frame and a second end coupled to a link, the link being coupled to the supporting means, and means to fold at least one end of the supporting means about a transverse axis to the pivot axis to permit raising one end of the mattress, said means to fold being normally detached from the supporting means and movable to abut and rise the supporting means to raise the end of the mattress.

18. The bed of claim 17, further comprising means for automatically controlling the actuating means so that supporting pivot is in a controlled sequence to fold and unfold a mattress supported on the supporting means.

19. The bed of claim 17, wherein the pivoting means includes a transverse brace attached to the supporting means and an actuating arm orthogonally attached to the transverse brace, the actuating arm being coupled to the link.

20. The bed of claim 19, wherein the supporting means includes a plurality of support plates having lateral edges, the plates being hinged coupled together along the lateral edges to form a mattress support surface.

21. The bed of claim 20, wherein the transverse brace is attached to at least one of the support plates and extends transversely beyond the at least one of the support plates to partially underlie the remaining support plates.

* * * * *